US011710901B2

(12) United States Patent
Sun et al.

(10) Patent No.: US 11,710,901 B2
(45) Date of Patent: Jul. 25, 2023

(54) COMPACT AND EFFICIENT MAGNETODIELECTRIC ANTENNA

(71) Applicant: Winchester Technologies, LLC, Burlington, MA (US)

(72) Inventors: Nian Sun, Winchester, MA (US); Patanjali V Parimi, Liverpool, MA (US); Chia-Shih Cheng, Milpitas, CA (US); Hwaider Lin, Somerville, MA (US)

(73) Assignee: Winchester Technologies, LLC, Burlington, MA (US)

( * ) Notice: Subject to any disclaimer, the term of this patent is extended or adjusted under 35 U.S.C. 154(b) by 32 days.

(21) Appl. No.: 17/352,752

(22) Filed: Jun. 21, 2021

(65) Prior Publication Data

US 2022/0407230 A1 Dec. 22, 2022

(51) Int. Cl.

*H01Q 7/08* (2006.01)
*H01F 10/24* (2006.01)
*H01F 1/34* (2006.01)
*H01Q 1/38* (2006.01)

(52) U.S. Cl.

CPC ..... *H01Q 7/08* (2013.01); *H01F 1/348* (2013.01); *H01F 10/24* (2013.01); *H01Q 1/38* (2013.01)

(58) Field of Classification Search

CPC .. H01Q 7/08; H01Q 1/38; H01F 1/348; H01F 10/24

See application file for complete search history.

(56) References Cited

U.S. PATENT DOCUMENTS 9,246,232 B2 * 1/2016 Sauleau ..... H01Q 13/22

* cited by examiner

*Primary Examiner* — Seung H Lee

(74) *Attorney, Agent, or Firm* — Jie Tan; JT Law Services PC

(57) ABSTRACT

Two or more high permeability magnetodielectric slabs in combination with electrical coils wound on each slab form a compact antenna that radiates electromagnetic signals efficiently in the omnidirectional pattern.

20 Claims, 12 Drawing Sheets

COMPACT AND EFFICIENT MAGNETODIELECTRIC ANTENNA

BACKGROUND

Field of the Invention

The present patent application relates to a type of ultra-compact and efficient antennas for use in wireless communication systems, satellite and radar systems. More particularly, the present patent application provides an antenna that is capable of receiving electromagnetic (EM) signals from an AC source operating anywhere from 1 kHz to 1 GHz frequency and radiating the same EM signals into the air. This highly efficient and yet compact antenna comprises a layered radiating aperture formed by a combination of electrical coils or metal strips and high permeability magnetodielectric material slabs stacked on top of one another.

Description of the Related Art

Antennas are used in all radiation communications. Currently dipole or monopole antennas are used for high frequency electrical communications, but their sizes are large because of the half-wavelength electrical length requirement for efficient radiation. Many efforts have been made to reduce the antenna sizes, examples of such efforts include using different loading techniques such as inserting lumped elements in the antenna structure, including dielectric, magnetic, and metamaterial loading. However, the loss caused by these loaded elements limits the radiation efficiency. Commercially available antennas operating in high frequency (HF), very high frequency (VHF), and ultrahigh frequency (UHF) bands are typically monopoles with a ground plane that are ~$\lambda/4$ or longer in length, where $\lambda$ is the wavelength of the operation frequency. The wavelengths range from 3 decimeter to 100 meters. Large antennas are not easy or even problematic for transportation, make easier targets for destructive forces. Accordingly, there is a need for an improved compact and highly efficient antennas.

ASPECTS AND SUMMARY OF THE INVENTION

In response to these market need, a new approach for antenna design provided a compact yet highly efficient antenna by using a combination of electric coils and layers of magnetodielectric material slabs. In one embodiment, two slabs of magnetodielectric material are spaced apart with a gap of at least $\lambda_0/2000$ and a metallic wire is wound around each slab for at least one half turn. In one aspect of the embodiment, the two ends of the coil wire wound on the first slab are connected to the positive (or negative) terminal of the AC source or feed network, and the two ends of the coil wire wound around the second slab are connected to the corresponding negative (or positive) terminal of the AC source or feed network. In this configuration, the said antenna is referred to as a dual slab magnetodielectric (DSM) antenna.

In another embodiment, a combination of electric coils and layers of magnetodielectric material slabs allows for significantly reducing the antenna size and enhancing the radiation efficiency. At least two or more magnetodielectric material slabs spaced apart by a gap of at least $\lambda_0/2000$. A metallic wire is wound around each slab having at least one turn around the slab, the ac source or feed network's positive and negative terminals are connected to the two ends of the coil wire wound around each slab. A power divider is used to split the source signals to feed multiple coils wound around the slabs making the staked slab a compact antenna array. In this configuration, the said antenna is referred to as a stacked magnetodielectric array (SMA) antenna.

In another embodiment, at least two metallic coils, coil 1 and coil 2 wound around the magnetodielectric slabs, are connected in series, the other ends of coil 1 and coil 2 are connected to the AC source or feed network. Each coil has at least one turn around the magnetodielectric slab. In this configuration, the antenna is referred to as a dual slab series-connected magnetodielectric (DSSM) antenna.

High permeability and electrical coil wound on each slab to produce a compact DSM, SMA and DSSM antennas that radiates electromagnetic signals efficiently.

In one embodiment, the magnetodielectric slabs are made of a garnet ferrite like yttrium iron garnet spinel ferrite, hexaferrite, or such high permeability material, the other properties of these materials may include high value of resistivity, permittivity, saturation magnetization, low power losses, and coercivity.

In one embodiment, the magnetodielectric slabs are separated by a small distance leaving a gap between them which is, at least, $\lambda/2000$, at least two such magnetodielectric slabs are used DSM antenna DSM antenna design. In one aspect, the shape of the magnetodielectric slab is circular disc, square, rectangle, triangular, pentagon hexagon, or any other 2-dimensional shape, and with a certain thickness, the gap between the magnetodielectric slabs is filled with air, dielectric, ferroelectric, magnetic material with lower permeability than that of the magnetodielectric material slab, or a combination of such materials. In one aspect, a conductive wire is wound at least a half turn around each slab forming a coin around each slab, and the number of turns of the coil can vary from 1 to the maximum that can be accommodated within the length and width of the magnetodielectric slab.

In one aspect, the two ends of the first coil wire on the first slab are connected to the positive (or negative) terminal of the AC source or feed network, and the two ends of the second coil wire wound around the second slab are connected to the negative (or positive) terminal of the AC source or feed network. In one aspect the coil pitch distance between the coil turns varies from 1 micron up to the maximum dimension of the magnetodielectric material in the x-y plane. In one aspect n the coil is made of electrically conducting material such as copper, silver, iron, steel, or an alloy of such metals, or carbon graphene strips wherein the coil is formed by a round wire with a certain diameter or a metal strip of certain thickness and width. The diameter or thickness, and width of the coil vary for carrying low (0-1 Amp) or high (1-1000 Amp) electrical currents. The combination of magnetodielectric slabs and electric coils results in a DSM antenna with significantly reduced size and enhances radiation efficiency.

In one aspect of a DSM antenna, the DSM antenna produces an omnidirectional azimuth radiation pattern similar to a monopole antenna. In aspect, the DSM antenna magnetodielectric slabs are placed horizontally in an x-y plane with the thickness in the z-direction, the radiation pattern has maximum signal strength in the x-y plane, and minimum signal is radiated in the z-direction, producing a null in the z-direction, DSM antenna produces radiation with electric field polarization oriented along the thickness direction (z-direction) the DSM antenna produces peak gain in the azimuth greater than 3 dB, and the DSM antenna is of size at least 40 times smaller compared to the commercially available TRAM1607-HC VHF Marine Antenna operating in the VHF frequency. In one aspect, a DSM antenna can be used with or without a ground plane. The purpose of the ground plane is to enhance the radiation peak gain and/or mounting the DSM antenna at a physical location, surface of the ground plane can be smooth, rugged, planar, singly or doubly curved, concave or convex convex-shaped, or any other geometric shaped, and the ground plane is made of a metal, an alloy of metals, dielectric, magnetic, magnetodielectric, ferroelectric, piezoelectric, a combination such materials, or a vehicle-top, on a side or on a front surface, or any other construction having its surface that is beneath or on top of the DSM antenna larger or smaller than the DSM antenna itself.

In aspect, a ground plane is placed at a distance from 0to a quarter electromagnetic wavelength, λ/4, beneath or on top of the DSM antenna along the thickness direction. For electromagnetic communications and radar applications, multiple DSM antennas are used as an array to increase the radiation gain in the azimuth. Multiple DSM antennas are mounted one on top of another or side by side, with the distance between the DSM antennas less than one EM wavelength, to increase the radiation peak gain in the azimuth to >3 dB.

High permeability magnetodielectric material slabs and an electrical coil wound on the slab to produce a compact stacked magnetodielectric antenna array (SMA) antenna that radiates electromagnetic signals efficiently, the magnetodielectric slabs may be made of a garnet ferrite, such as yttriumiron garnet, spinel ferrite, hexaferrite, or such high permeability material. The other properties of these materials include high value of resistivity, permittivity, saturation magnetization, low power losses, and coercivity. In one aspect, the magnetodielectric slabs are separated by a small distance leaving a gap between them which is, at least, λ/2000. In aspect, the shape of the magnetodielectric slabs can be a circular disc, square, rectangle, triangular, pentagon hexagon, or any other 2-dimensional shape, with a certain thickness. The gap between the magnetodielectric slabs can be filled with air, dielectric, ferroelectric, magnetic material with lower permeability, or a combination of such materials. In one aspect, a metallic wire is wound around each slab, having at least one turn around the slab. The number of turns of the coil vary from 1 to those that can be accommodated within the width and length of the magnetodielectric slab.

In one aspect of SMA antenna, a metallic wire is wound around each slab, having at least one turn around the slab and the positive and negative terminals of the AC source or feed network are connected to the two ends of the coil wire wound around each slab. In one aspect, a power divider is used to split the source signal to feed multiple coils wound around the slabs making the staked slab a compact antenna array. In one aspect, the distance between the coil turns varies from 1 micron up to the maximum dimension of the magnetodielectric material in the x-y plane. And the coil is made of electrically conducting material such as copper, silver, iron, steel or an alloy of such metals, wherein the coil is made of a round wire with a certain diameter or a metal strip with a certain thickness and width, the diameter or thickness and width of the coil vary for carrying low (0-1 Amp) or high (1-1000 Amp) electrical currents. An SMA antenna has significantly reduced size and enhanced radiation efficiency. An SMA antenna produces an omnidirectional azimuth radiation pattern similar to a monopole antenna. Mounting an SMA antenna magnetodielectric slabs horizontally in an x-y plane with the thickness in the z-direction results in radiation pattern with a maximum signal strength in the x-y plane and a minimum signal in z-direction, producing a null in the z-direction. An SMA antenna produces TM, TE, or a combination of such radiation modes, SMA antenna produces radiation with electric field polarization oriented along the thickness direction (z-direction) of the magnetodielectric slabs. A SMA antenna produces peak gain in the azimuth greater than or equal to 3 dB while the size of a SMA antenna is at least 40 times smaller compared to commercially available TRAM1607-HC VHF Marine Antenna operating in the VHF frequency. In one aspect, mounting the SMA antenna to a ground plane enhances the radiation peak gain wherein the ground plane is made of a metal, an alloy of metals, dielectric, magnetic, magnetodielectric, ferroelectric, piezoelectric, a combination these materials, a vehicle-top, on a side or on a front surface, or any other construction having its top surface that is beneath the ASM antenna larger or smaller than the SMA antenna itself. Wherein the ground plane is placed at a distance anywhere from 0 to a quarter electromagnetic (EM) wavelength, λ/4, beneath or on top of the SMA antenna. And the surface of the ground plane can be smooth, rugged, planar, singly or doubly curved, concave or convex convex-shaped, or any other geometric shaped. In electromagnetic communications and radar applications, multiple SMA antennas are used as an array to increase the radiation gain in the azimuth. multiple SMA antennas are mounted one on top of another or side by side, with the distance between the SMA antennas less than one EM wavelength, to increase the radiation peak gain in the azimuth to >3 dB.

High permeability magnetodielectric material slabs and electrical coil wound on each slab also produce a compact dual slab series-connected magnetodielectric (DSSM) antenna that radiates electromagnetic signals efficiently. The magnetodielectric slabs may be made of a garnet ferrite like yttrium-iron garnet, spinel ferrite, hexaferrite, or such high permeability material. The other properties of these materials include high value of resistivity, permittivity, saturation magnetization, low power losses, and coercivity. The magnetodielectric slabs are separated by a small distance leaving a gap between them which is, at least, λ/2000 and at least two such magnetodielectric slabs are configured in DSSM antennas. The shape of the magnetodielectric slabs can be circular disc, square, rectangle, triangular, pentagon hexagon, or any other 2-dimensional shape, with a certain thickness. The gap between the magnetodielectric slabs can be filled with air, dielectric, ferroelectric, magnetic material with lower permeability than that of the magnetodielectric material slab, or a combination of such materials. The metallic wire is wound around each slab, for at least one turn around the slab. The number of coil turns can vary from 1 to the maximum turns within the length and width of the magnetodielectric slabs.

In a DSSM antenna, one end of the coil on slab1 is connected to one terminal of an AC source or feed network, the other end of the coil of slab 1 is connected to one end of the coil on slab2, the other end of the coil on second slab is connected to the other terminal of the AC source or feed network. The distance between the coil turns varies from 1 micron up to the maximum dimension of the magnetodielectric slabs in the x-y plane. The coil is made of electrically conducting material such as copper, silver, iron, steel, or an alloy of such metals, the coil is made of a round wire with a certain diameter or a metal strip of a certain thickness and width. The diameter or thickness and width of the coil vary for carrying low (0-1 Amp) or high (1-1000 Amp) electrical currents.

The DSSM antenna produces an omnidirectional azimuth radiation pattern similar to a monopole antenna. Mounting a DSSM antenna magnetodielectric slabs horizontally in an x-y plane with the thickness in the z-direction produces a radiation pattern with maximum signal strength in the x-y plane and minimum signal strength in z-direction, i.e. a null in the z-direction. The radiation with electric field polarization oriented along the thickness direction (z-direction), peak gain in the azimuth is at least, 3 dB. A DSSM antenna is 40 times smaller compared to commercially available TRAM 1607-HC VHF Marine Antenna operating in the VHF frequency. Mounting a ground plane further enhances the radiation peak gain. the surface of the ground plane can be smooth, rugged, planar, singly or doubly curved, concave or convex convex-shaped, or any other geometric shaped and the ground plane can be made of a metal, an alloy of metals, dielectric, magnetic, magnetodielectric, ferroelectric, piezoelectric, a combination such materials, a vehicle-top, —on a side or on a front surface, or any other construction having its surface that is beneath or on top of the DSSM antenna larger or smaller than the DSSM antenna itself. The ground plane is placed at a distance anywhere from 0 to a quarter EM wavelength, $\lambda/4$, beneath or on top of the DSSM antenna along the thickness direction. For electromagnetic communications and radar applications, multiple DSSM antennas are assembled one on top of another or side by side, as an array to increase the radiation gain in the azimuth. The distances between the DSM antennas range less than one EM wavelength, resulting increase of the radiation peak gain in the azimuth to >3 dB.

The advantages of the DSM, SMA, and DSSM antennas are that they are miniaturized in size and produce efficient power radiation with high gain. Compared with the TRAM1607-HC marine monopole antenna, DSM, SMA, and DSSM antennas are dramatically lower in profile, highly compact with a 41× size reduction, and can be used for planar and conformal applications without performance degradation. Due to the compact size and low profile, the DSM, SMA and DSSM antennas can be used for covert and concealed applications. The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1A:
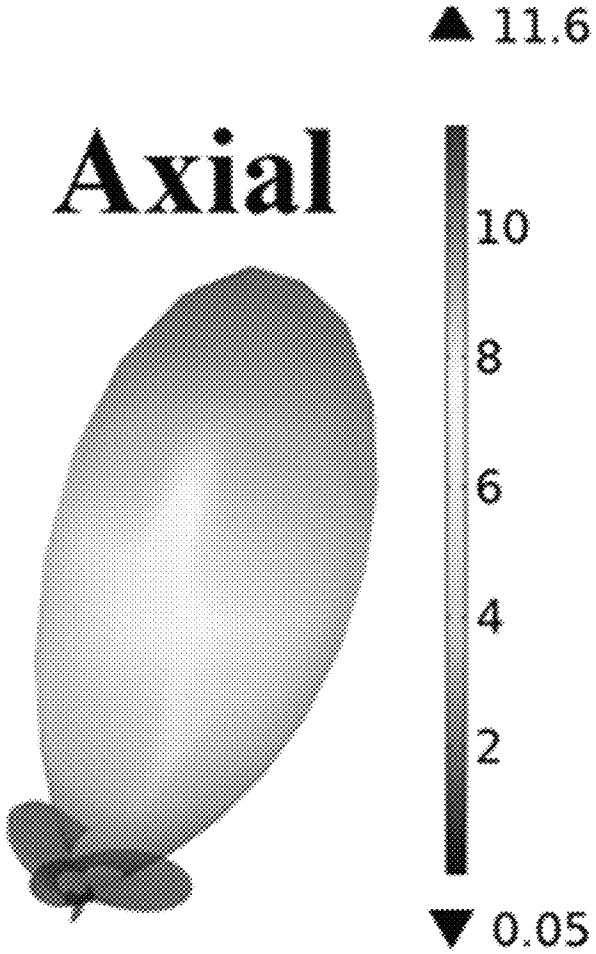
FIGS. 1A and 1B show radiation patterns of a solenoid helical antenna for both axial and normal modes in accordance with this application.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

The present invention may be described herein in terms of functional block components and various processing steps. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical incentive system implemented in accordance with the invention.

The term "magnetodielectric material" refers to material having relative permeability and permittivity either greater than 1 or less than 1 but not 1. Its permittivity and permeability are frequency dependent. A magnetic material is a material with a relative permeability greater than or less than one and relative permittivity equal to 1. Dielectric materials are electrical insulators with a permittivity greater than or less than one and a permeability equal to one. Magnetodielectric materials are ceramic or composite materials that possess both the properties of magnetic and dielectric materials. For example, a dielectric material can be doped with a magnetic material to add the magnetic behavior. The common magnetic materials include garnet ferrite like yttrium iron garnet, spinel ferrites, hexaferrites, ferrite/epoxy, ferrite FeGaB/AlOx, Fe, Ga, and B(FeGaB) mixed AlOx material. High permeability magnetic material may be deposited as a film on a dielectric substrate material using one of the many deposition methods available, such as spin spray, pulsed laser deposition, RF magnetron sputtering, chemical vapor deposition, and physically placing the thin film on a dielectric substrate material.

The term "helical antenna" refers to an antenna consisting of one or more conducting wires wound in the form of a helix. The two ends of the helix are connoted the excitation AC signal. In most cases, directional helical antennas are mounted over a ground plane, while omnidirectional designs may not be.

The term "coil" refers to a length of an electric deductive material arranged in a spiral or sequence of rings. If the coil is made up of a single turn or a single loop of the conductor, it is called a single turn coil, if it is made up of a half turn of a conductive material, it is called a half turn coil.

The term of "coil pitch" refers to the peripheral distance between two same sides of adjacent coil turns.

The term "conductive" refers to any conductive material, including graphene and metals.

For directional helical antennas, one end of the helix is connected to the ground plane, the two terminals of the excitation signal are connected to one end of the helix which is not connected to the ground place, and the other end is connected to the ground plane. The feed line is connected between the bottom of the helix and the ground plane.

In the conventional coil antenna in which a helical coil is employed, two different radiation patterns can be obtained: the normal mode and axial mode patterns. The operation frequency of the helical antenna is determined by the circumference of the coil used. In the axial mode or end-fire helical antenna, the diameter and pitch of the helix are comparable to a wavelength. The antenna functions as a directional antenna radiating a beam off the ends of the helix, along the antenna's axis. It radiates circularly polarized radio waves, as shown in FIG. 1A. These are often used for satellite communication.

If the circumference of the helix is significantly less than a wavelength and its pitch (axial distance between successive turns) is significantly less than a quarter wavelength, the antenna is called a normal-mode helix. These antennas act similar to a monopole antenna, with an omnidirectional radiation pattern, radiating equal power in all directions perpendicular to the antenna's axis, as shown in FIG. 1B.

Figure 1B:
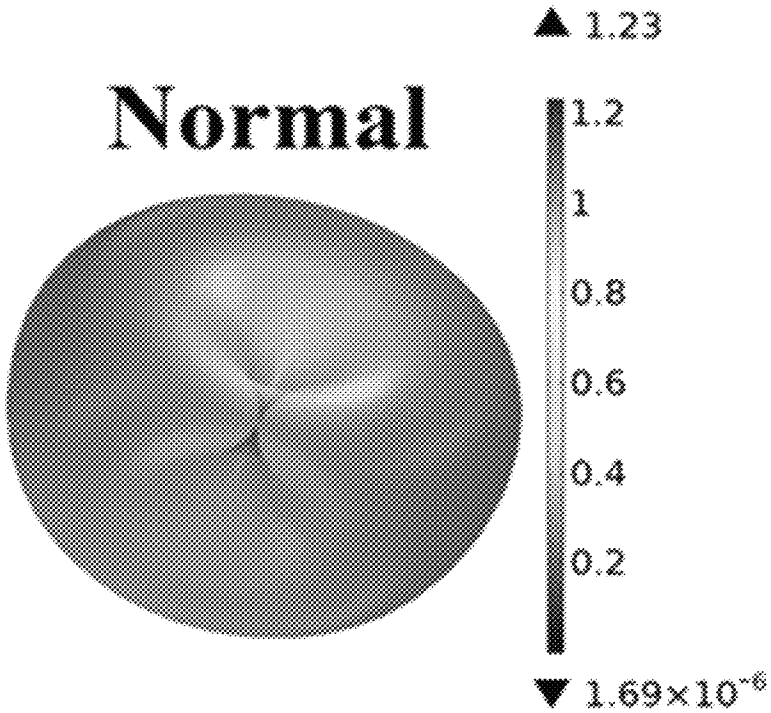

FIGS. 1A and 1B show the numerical simulation results of the radiation patterns for both modes. In the axial mode (FIG. 1A), which occurs at a higher frequency than the normal mode, the radiation is focused along the coil axis. In the normal mode (FIG. 1B), the radiation pattern is omnidirectional in the azimuth plane, which is defined as the plane perpendicular to the helical coil's axis. Helical antennas and monopole antennas are three dimensional structures that are not amenable for conformal and planar mounting on mobile land, air, and sea vehicles.

Magnetic ferrite materials haven been effectively employed for helical antennas as such helical antennas have better performance efficiency. A broadband ferrite loop antenna is designed to enhance the bandwidth. U.S. Pat. No. 6,919,856 to Huelsbeck et al describes a tunable ferrite coil for tuning to a desired frequency or inductive value. U.S. Pat. No. 6,529,169 to Justice describes twin coils winding a ferrite core antenna where the two signal pick-up coils coupled through a transformer is employed to tune the antenna to select frequencies and signal amplification. U.S. Pat. Nos. 6,919,856 and 6,529,169 are incorporated by reference herein for background knowledge purposes. However, none of these patents have a focus about reducing the antenna size and at the same time enhancing the antennas radiated power efficiency.

Figure 2:
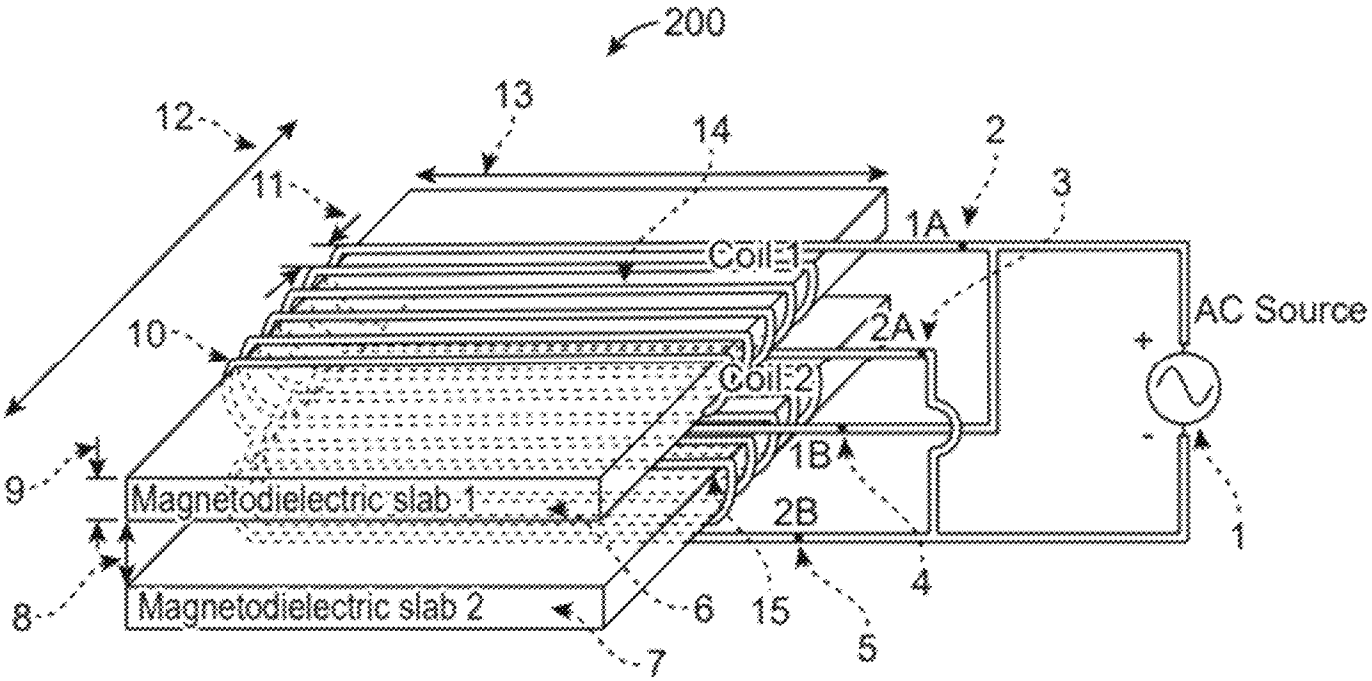
FIG. 2 shows a dual slab magnetodielectric (DSM) antenna and its feed mechanism in accordance with this application.

In reference to FIG. 2, a compact dual slab magnetodielectric (DSM) antenna 200 is constructed using two low loss high permeability magnetodielectric slabs 6, 7 separated by a distance 8. A conducting metal strip or wire coil 1 and coil 2 with a specific diameter or metal strip with specific width and thickness is wrapped around each of the two magnetodielectric slabs.

The use of magnetodielectric material as the slabs significantly reduces the size of the antenna and at the same time enhances the radiation efficiency which is defined as the total power radiated, and allows for conformal mounting and integration of the antenna with the mobile ground, air, and sea vehicles, and any other planar, singly and doubly curved surfaces. Due to this flexibility in mounting and the portability, the DSM antennas shown FIG. 2 can be used for commercial and military electromagnetic communication and radar systems.

The magnetodielectric material slabs may be made of a garnet ferrite like yttrium iron garnet, spinel ferrite, hexaferrite, or a combination such high permeability magnetic materials. High permeability magnetic material may be deposited as a film on a dielectric substrate material using one of the many deposition methods available, such as spin spray, pulsed laser deposition, RF magnetron sputtering, chemical vapor deposition, and physically placing the thin film on a dielectric substrate material. Whereas any low-loss magnetic material can be used for the design of the DSM antenna as shown in FIG. 2, the ferrite that was used in the demonstration of the performance in the example DSM, DSSM, and SMA antennas in this application is TTZ-500 from Trans-Tech company. The TTZ-500 is a composition based on the Z-type hexagonal ferrite material with permeability $\mu'>7$ and a magnetic Q ($\mu'/\mu''$)>15 (at 500 MHz) that is specifically designed for antenna applications below 500 MHz.

The separation distance 8 between the magnetodielectric slabs 6, 7 can range from 0 to one wavelength in a corresponding the operation frequency. Gap 8 between the magnetodielectric slabs 6, 7 offers two advantages: 1) it increases the surface area of the radiating aperture such that the radiation efficiency is increased and 2) it matches input impedance of the DSM antenna to the feed network. Coil 1 and Coil 2 wires with a specific diameter or metal strip with specific width and thickness are wrapped around each of the two magnetodielectric slabs.

In operation, an alternating electromagnetic signal is fed by connecting the two feed points from a signal source 1 to the two coils 14, 15 wound around the magnetodielectric slabs 6 and 7 respectively in such a way that the top 6 and bottom 7 slabs are excited with opposing fields at any given time. In other words, the two ends 2, 4 of coil 14 are connected to one terminal of source 1, and the two ends 3, 5 of coil 15 are connected to the other terminal of source 1.

Coils 14, 15 will excite the magnetodielectric material by feeding the electromagnetic signals to them. Unlike a helical antenna where the helix's circumference determines the operation frequency, the operation frequency in DSM antenna is determined by the length 12 and width 13 of the magnetodielectric slabs used. Depends on the actual material of the effective permeability and permittivity of the magnetodielectric slabs, the resonance operation frequency is determined as $$f=v/\lambda_g \tag{1}$$

where f is the operation frequency, v is the velocity of the EM wave in the effective medium that contains both the magnetodielectric material slabs and the surrounding medium, and $\lambda_g$ is the effective guide wavelength which is determined as $$\lambda_g=\lambda_0/\mathrm{Sqrt}(\mu_{eff}\varepsilon_{eff}). \tag{2}$$

$\lambda_0$ is the free space wavelength, and $\mu_{eff}$ and $\varepsilon_{eff}$ are the effective relative permeability and permittivity of the magnetodielectric slabs and surrounding medium.

It is observed that minor variation in the radiation pattern can be obtained without affecting the omnidirectional azimuthal pattern by changing the numbers of winding turns, pitch 11, and diameter 10 of the coils 14, 15.

Figure 6B:
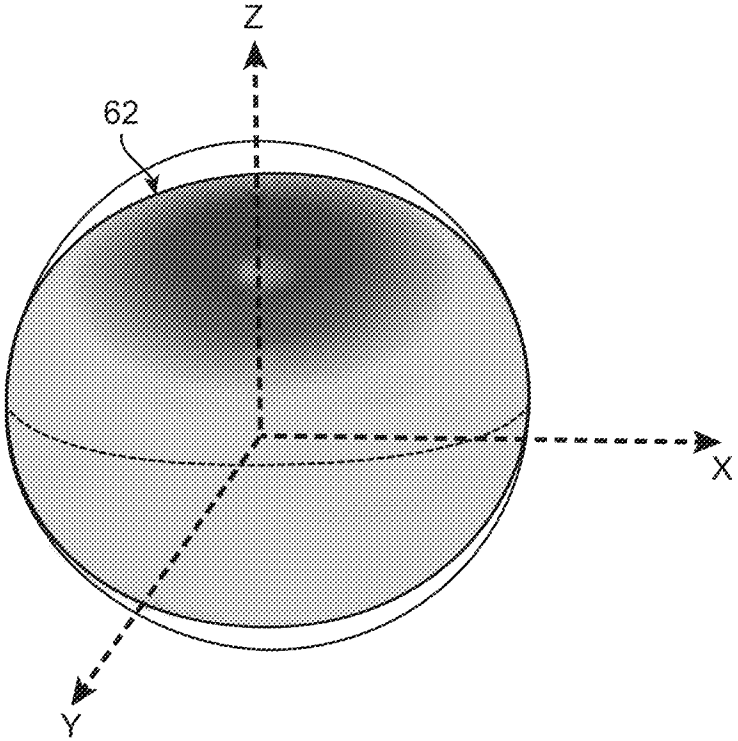
FIGS. 6A and 6B show a typical omnidirectional azimuth radiation pattern of the DSM, SMA, and DSSM antennas as measured in accordance with this application.
Figure 6A:
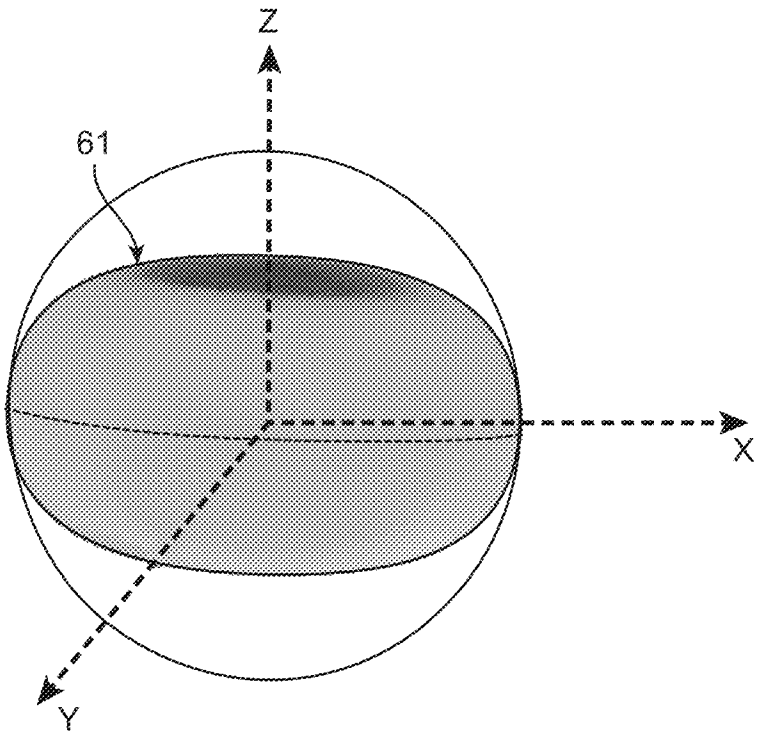

In reference to FIGS. 6A and 6B, a DSM antenna's omnidirectional azimuth radiation pattern is measured as a radiation pattern with maximum nearly constant radiation 61 in and around the azimuth plane (x-y plane), which is perpendicular to the magnetodielectric distance 8 and thickness 9 direction of slabs 6, 7. Along distance 8 and thickness 8, 9 direction, which corresponds both the positive and negative Z directions, the radiation ceases to exist, forming radiation nulls. Such omnidirectional pattern obtained with a DSM antenna is similar to the omnidirectional pattern corresponding to the normal mode of helical and Marine VHF Antennas.

A similar azimuth radiation pattern is also obtained with an alternative antenna designs using a combination of electric coils and layers of magnetodielectric material slabs that is also demonstrated to reduce the antenna size significantly and to enhance the radiation efficiency.

Figure 3:
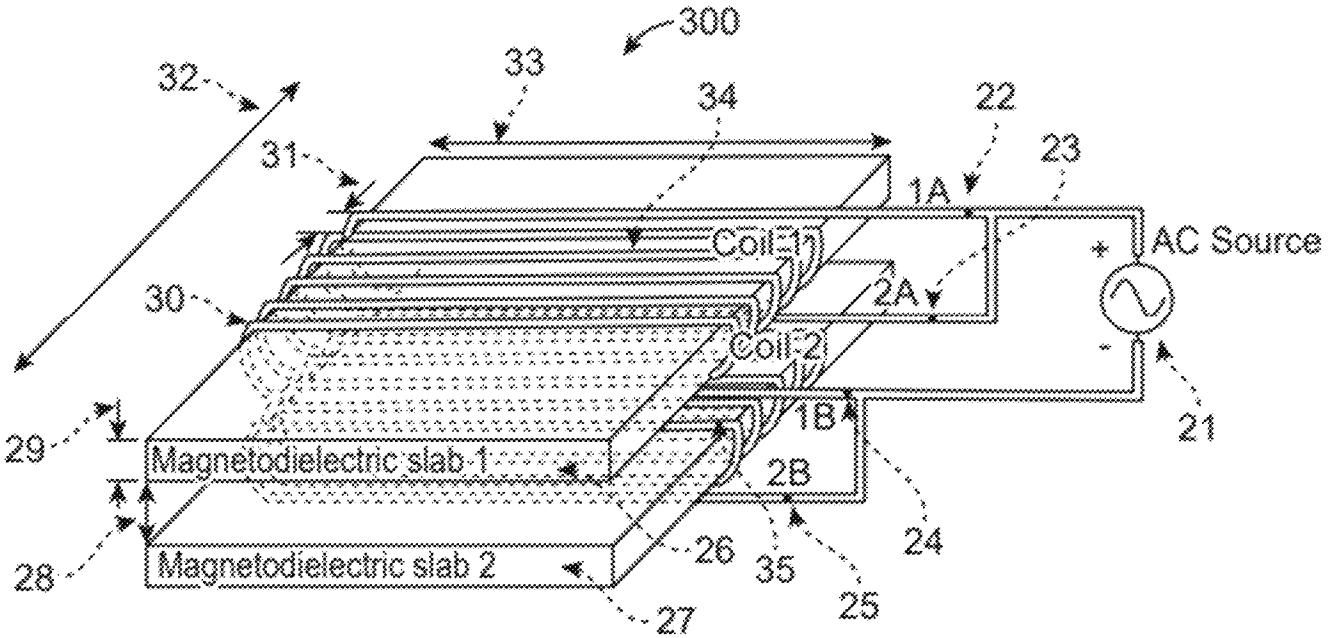
FIG. 3 shows a stacked magnetodielectric array (SMA) antenna and its feed mechanism in accordance with this application.

In reference to FIG. 3, SMA antenna 300 has at least two or more magnetodielectric material slabs spaced apart by a small distance leaving a gap 28 which is at least λ/2000. Metallic wires 34, 35 are wound around each slab having at least one turn around the slab. The positive and negative terminals of the AC source or feed network 21 are connected to the two ends 22 and 24 of coil wire 34 that wounds around each slab 26. Similarly, the positive and negative terminals of source 21 are connected to the two ends 23 and 25 of the wire 35. The source signal may be fed to multiple coils wound around the slabs making the stacked slabs a compact antenna array. In this configuration, the antenna is referred to as a stacked magnetodielectric array (SMA) antenna.

Another omnidirectional radiation pattern is obtained from another alternative antenna configuration. Similar to the configuration of DSM and SMA antennas a combination of electric coils and layers of magnetodielectric material slabs are used, instead of parallel connections, the two coils are series-connected, resulting in a dual slab series-connected magnetodielectric (DSSM) antenna. In reference to FIG. 4, the DSSM design 400 also reduces the antenna size significantly and enhances the radiation efficiency. The antenna has at least two or more magnetodielectric material slabs 46 and 47 spaced apart by a small distance leaving a gap 48 which is at least λ/2000. A metallic wire 54 is wound around slab 46, having at least one turn around the slab. Another metallic wire 55 is wound around slab 47, having at least one turn around the slab. One terminal of the AC source or feed network 41 is connected to one end 42 of coil 54. The other end 44 of coil1 54 is connected to one end 43 of coil 55 while the other end 45 of coil 55 is connected to the AC source 41.

Figure 4:
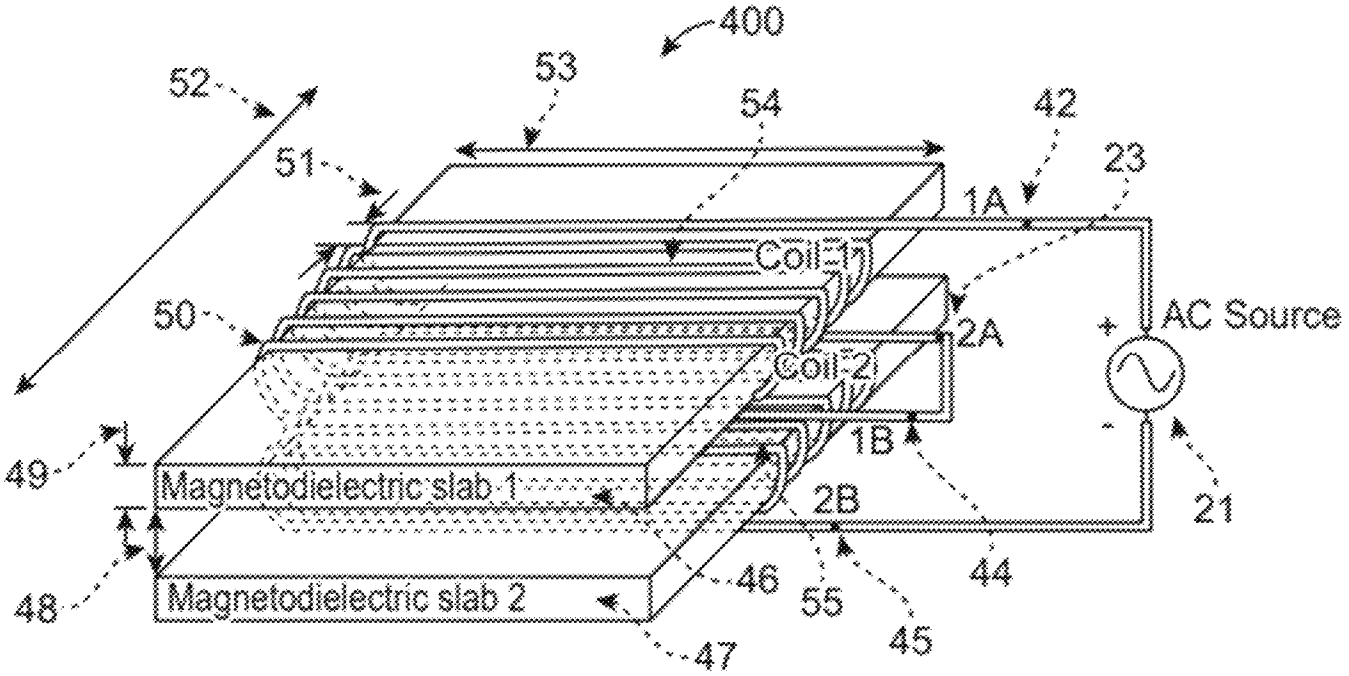
FIG. 4 shows a dual slab series-connected magnetodielectric (DSSM) antenna and its feed mechanism in accordance with this application.

Similar to the DSM antenna in FIG. 2, a low-loss magnetic material is used for the slabs of the SMA in FIG. 3 and the DSSM in FIG. 4 antennas. The ferrite used in the example SMA and DSSM antennas for measurement of performance is TTZ-500 procured from Trans-Tech. The gap 28 between the magnetodielectric slabs 26, 27 of SMA antenna, the gap 48 between the magnetodielectric slabs 46, 47 of DSM antenna provide two advantages: they increase the surface areas of the radiating aperture such that radiation efficiency is enhanced and they match the input impedance of the SMA and DSSM antennas to the feed network.

Figure 5:
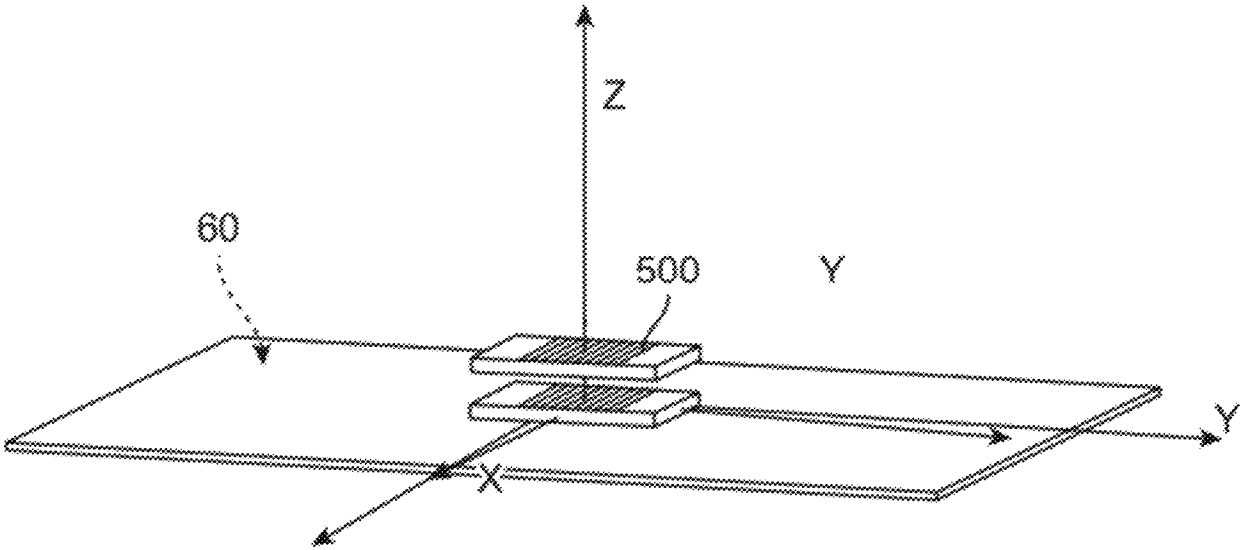
FIG. 5 shows a typical mounting of DSM, SMA, or DSSM antenna on a ground plane in accordance with this application.

Similar to the DSM antenna, SMA and DSSM antennas have a measured radiation pattern with their peak in and around the azimuth plane resulting in omnidirectional azimuth pattern shown in FIG. 5.

For DSM antenna of FIG. 2, the number of turns of the coils 14, 15 wound around the magnetodielectric slabs 6, 7 of the DSM can be varied from one half turn to as many as that can be accommodated within the size of the magnetodielectric slabs 6, 7. For SMA antenna of FIG. 3, the number turns of the coils 34, 35 and for the DSSM antenna of FIG. 4, the number of turns of coil 54, 55 can vary from one turn to as many as that can be accommodated within the size of their respective magnetodielectric slabs.

The distance between the coil turns 11, 31, 51 of the respective coils 14, 15, 34, 35, 54, and 55 can vary from 0 to length of the magnetodielectric slabs 6, 7, 26, 27, 46, and 47. The coils 14, 15, 34, 35, 54, and 55 can be made of an electrically conducting material such as copper, silver, iron, steel, or an alloy of such metals. The coils 14, 15, 34, 35, 54, and 55 can be in the form of a round wire with a specific diameter or in the form of a metal flat strip of a certain thickness and width. The round coil diameter or flat metal strip thickness can vary in order for carrying different electrical currents strengths for high power applications and preventing heating and damage to the coil or strip.

The DSM, SMA, and DSSM antennas can be mounted on a ground plane 60 shown in FIG. 5 for better radiation directivity in the azimuth plane. The ground plane 60 can be made of a metal, an alloy of metals, dielectric, magnetic, magnetodielectric, ferroelectric, piezoelectric, or a combination of these materials. The purpose of the said ground plane 60 is to enhance the radiation gain in a given direction, it also allows for mounting the DSM, SMA and DSSM antennas on a suitable surface such as ground, air, and sea vehicle surfaces, a top, front, back and sides of a human body or any other surfaces. The ground plane 60 can be a part of a vehicle-a top, -side, or -front surface, or any other construction having its one of the surfaces beneath or on top of the DSM, SMA and DSSM antennas, larger or smaller than the antenna itself.

It is observed that the surface of the ground plane 60 can be varied, such as smooth, rugged, planar, singly or doubly curved, concave or convex-shaped, or any other geometric shape without significantly affecting the omnidirectional azimuth pattern shape. However, concave and convex-shaped ground planes do change the radiation pattern in the azimuth, with the concave ground plane increasing the radiation above the azimuth plane and the convex ground plane decreasing the radiation above the azimuth plane. These minor variations in the ground plane design can be effectively used to improve the DSM and SMA antennas' radiation performance, including azimuth beam width and beam tilt in the upward or downward direction from the azimuth.

Figure 7:
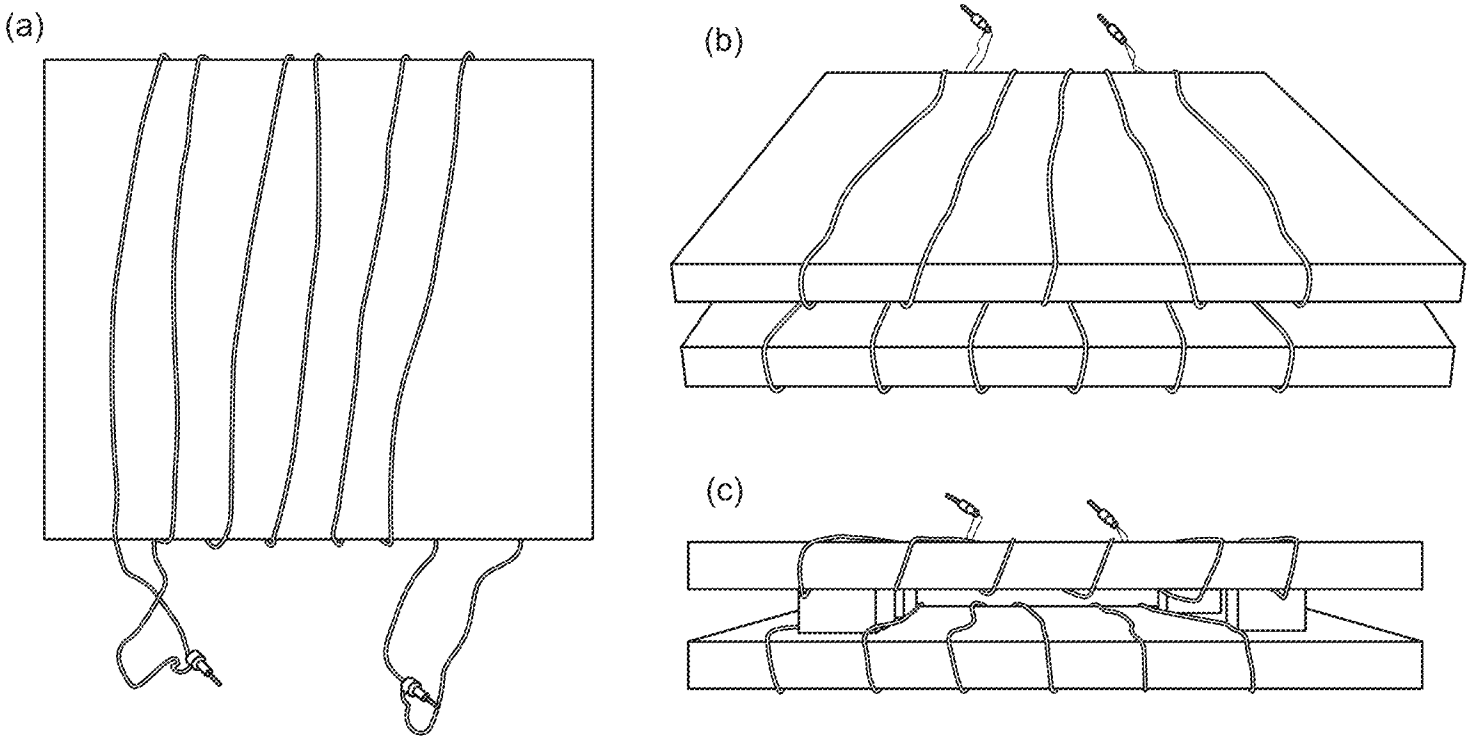
FIG. 7 shows photo images of a prototype SMA antenna, Panel (a) top view, Panel (b) side view, and Panel (c) air gap between the magnetodielectric slabs in accordance with this application.
Figure 8A:
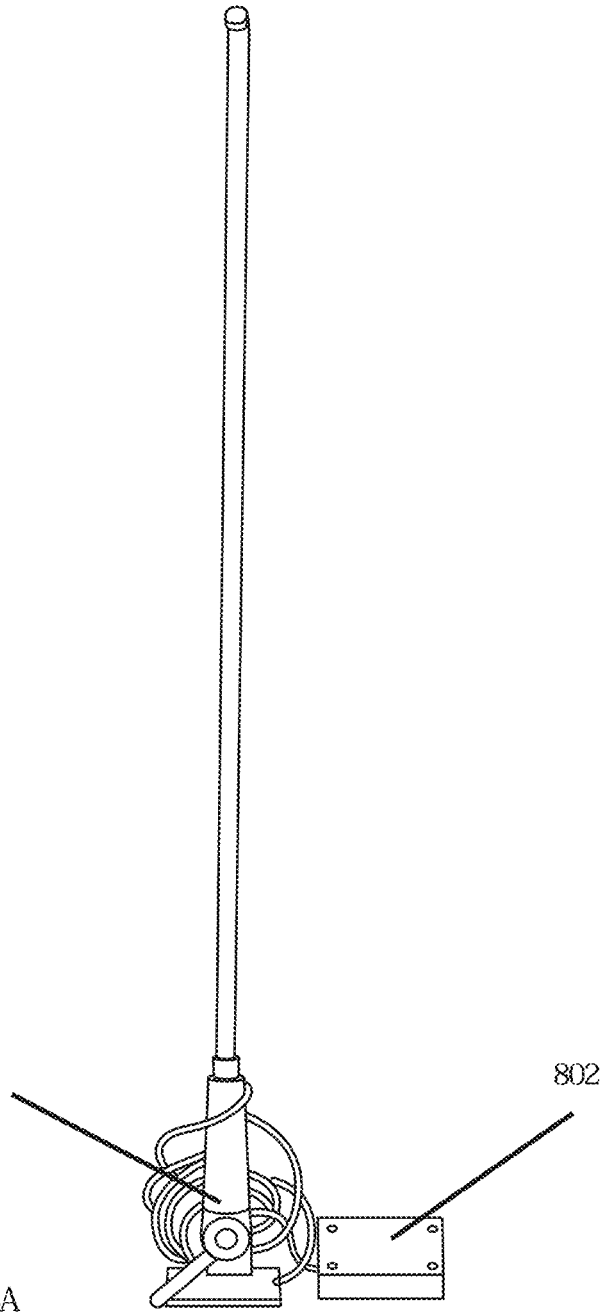
FIG. 8A shows photo images of an example magnetodielectric antenna in comparison with a TRAM-1607 antenna.
Figure 8B:
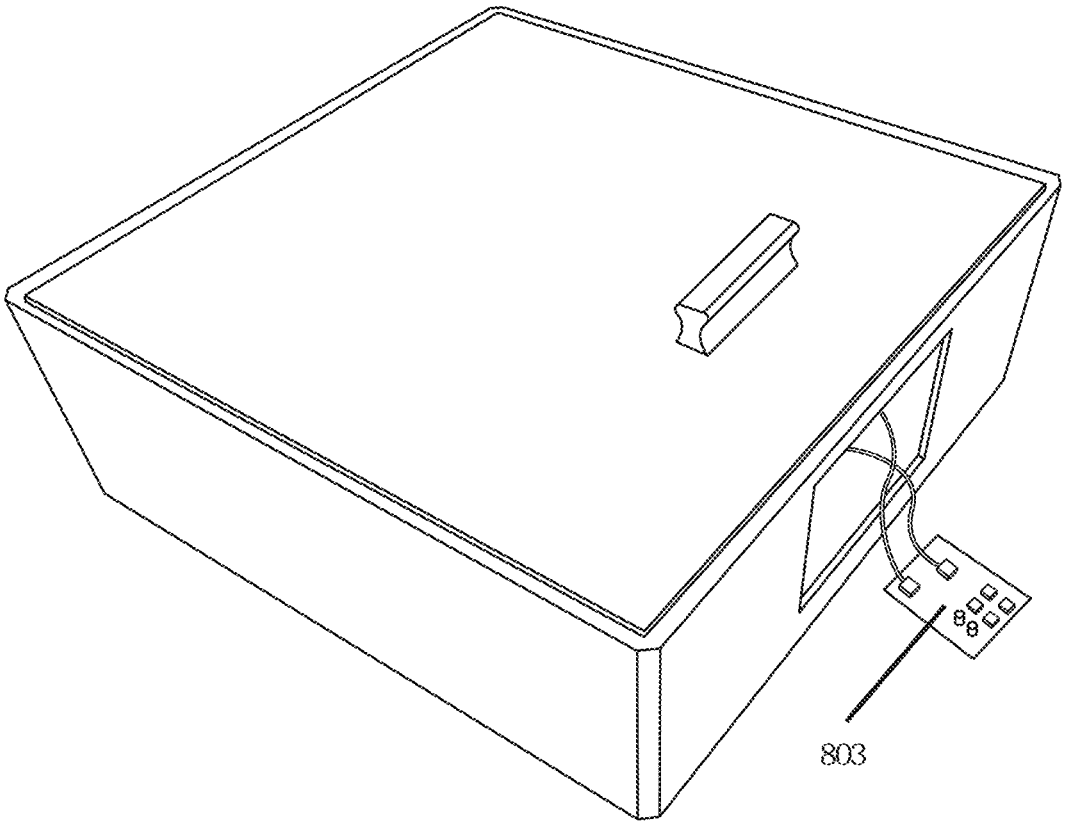
FIG. 8B shows a photo image of an example LC feed network mounted in a radome case.
Figure 9B:
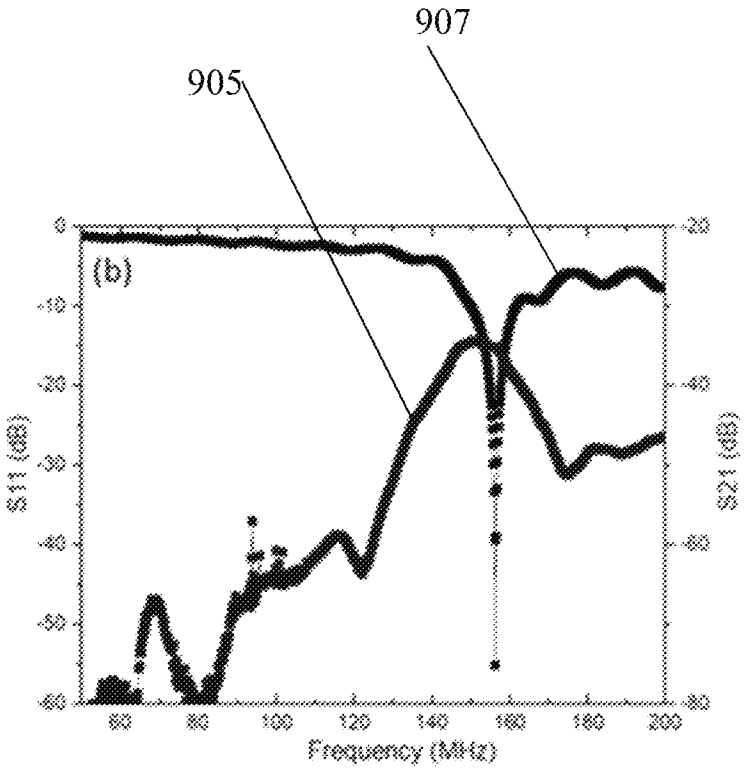
FIG. 9B shows measured return loss, S11, and free space transmission to the receiver, S21 of an example reference marine antenna TRAM-1607.
Figure 9A:
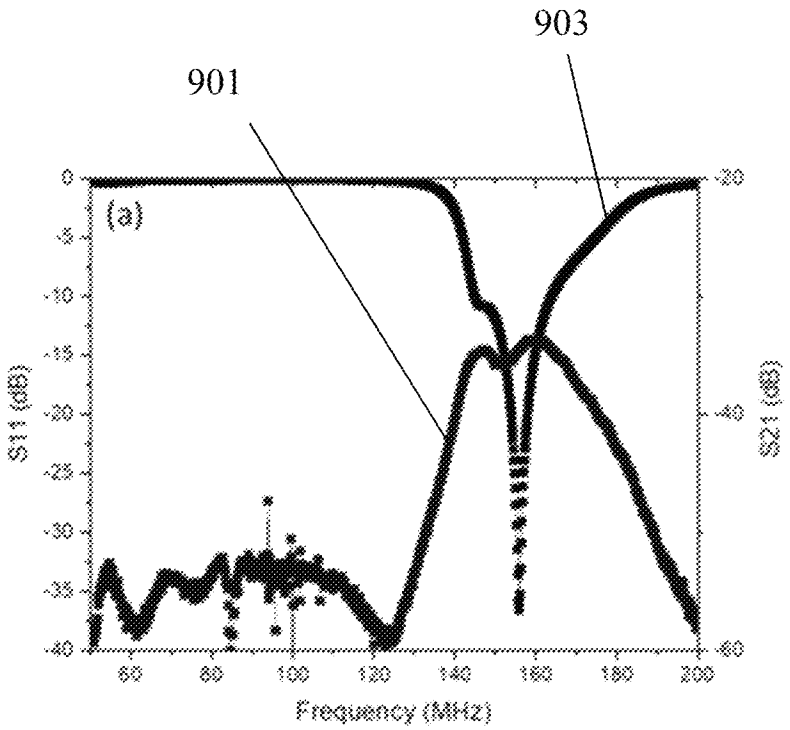
FIG. 9A shows measured return loss, S11, and free space transmission to the receiver, S21, representing a gain of 3 dBi of an example magnetodielectric antenna (DSM, SMA & DSSM) in accordance to this application.
Figure 9C:
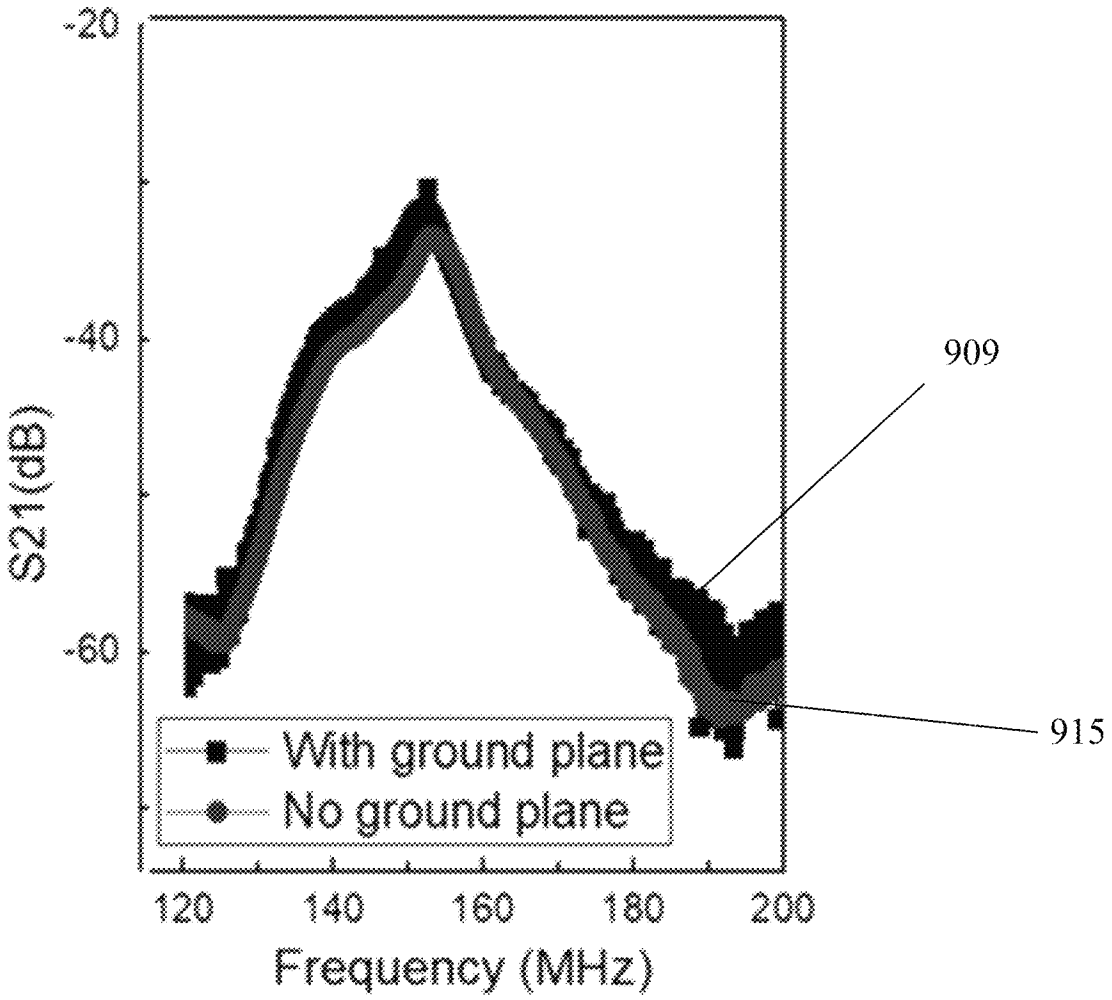
FIG. 9C shows measured and free space transmission to the receiver, S21, of an example magnetodielectric antenna (DSM, SMA & DSSM) with and without a ground plane, representing gains of 5.3 dBi and 3 dBi, respectively in accordance to this application.

Example DSM, SMA, and DSSM antennas, as shown in FIG. 7, were fabricated and successfully tested for their performance in comparison to a marine antenna (TRAM 1607-HC). The size comparison is shown in FIG. 8A the DSM, SMA, and DSSM antennas were 4×4×10 $in^3$, whereas the marine antenna TRAM 16-7-HC was of the size 51×5.2×2.5 $in^3$ FIG. 8B shows a LC feed network mounted in a radome case for the measurement conducted in FIG. 9A to 9C. FIG. 9B shows the TRAM 1607-HC measured return loss S11 (907), and free space transmission to the receiver S21 (905). FIG. 9A shows measured return loss S11 (903), and free space transmission to the receiver S21 (901) of the prototype magnetodielectric antenna (DSM, SMA & DSSM) representing a gain of 3 dBi. The DSM, SMA, and DSSM antenna gain was increased to 5.3 dB by placing a ground plane as shown in FIG. 9C, 915 refers to free space transmission to the receiver without a ground plane; 909 refers to free space transmission to the receiver with a ground plane. In addition, a bandwidth of 16 MHz is obtained, which outperforms the traditional marine monopole antenna that has a 3 dB gain and a bandwidth 12 MHz in the VHF band.

Table I summarizes the performance specifications of the DSM, SMA, and DSSM antennas. Compared with the TRAM 1607-HC marine monopole antenna, the DSM, SMA, and DSSM antennas are much lower in profile, highly compact with a 41× size reduction, and can be used for conformal applications without performance degradation. Due to their compact size and low profile, the DSM and SMA antennas can be used for covert and concealed applications.

TABLE I

Performance and Size Comparisons of Different Antennas

| Antenna | Gain at 156 MHz (dBi) | Bandwidth (MHz) | Size L × W × H (inch) | Omnidirectional pattern |
|---|---|---|---|---|
| DSM/SMA/DSSM antennas | 3 | 20 | 4 × 4 × 1 | Y |
| DSM/SMA/DSSM antenna on a ground plane | 5.3 | 16 | 4 × 4 × 1 | Y |
| Marine monopole reference antenna | 3 | 12 | 51 × 5.2 × 2.5 | Y |

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

Additional general background, which helps to show variations and implementations, may be found in the following publications, all of which are hereby incorporated by reference herein for all purposes:

[1] Kraus, J. D. Antennas 2nd Ed, MacGraw Hill, 1988.

[2] "Broadband Ferrite Loaded Loop Antenna", Meloling John Harold, Dawson David Carlos, Hansen Peder Meyer, U.S. Pat. No. 7,737,905, 2010.

[3] "Ferrite Antenna", Huf Huelsbeck, Fuerst G, and Neosid Pemetzrieder, U.S. Pat. No. 6,919,856, 2005

[4] "Twin coil antenna", Christopher M. Justice, U.S. Pat. No. 6,529,169, 2003

[5] "Millimeter thick magnetic print circuit boards (PCBs) with a high relative permeability of 50~150 and related devices and systems" Xiaoling Shi, Hui Lu, Nian Sun, Winchester Technologies, LLC, Burlington, Mass. 01803. US Patent application.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle. The claims as filed are intended to be as comprehensive as possible, and NO subject matter is intentionally relinquished, dedicated, or abandoned.

What is claimed:

1. A compact and efficient antenna, comprising:

a first magnetodielectric material slab having an x, y, z dimension with the z dimension being smaller than the x, y dimensions;

a second magnetodielectric material slab having an x, y, z dimension with the z dimension being smaller than the x, y dimensions, wherein the second magnetodielectric material slab is placed in parallel to the first magnetodielectric material slab with a gap;

a first conductive wire looping at least half a first coil turn around the first magnetodielectric material slab forming a first coil, having a first end and second end; and a second conductive wire looping at least half a second coil turn around the second magnetodielectric material slab, forming a second coil, having a third end and a fourth end, wherein the first coil and the second coil are connected to an AC source or a feed network producing an omnidirectional radiation in the azimuth plane with a gain equal to or greater than 3 dBi compared to a marine monopole antenna.

2. The antenna of claim 1, wherein the first coil and the second coil are connected in parallel to an AC source or a feed network.

3. The antenna of claim 1, wherein the first coil and the second coil are connected in series to an AC source or a feed network.

4. The antenna of claim 1, wherein the first end and the second end of the first coil are both connected to the negative terminal of an AC source or a feed network, and the third end and the fourth end of the second coil are both connected to the positive terminal of the AC source or the feed network.

5. The antenna of claim 1, wherein the magnetodielectric slabs comprises a material of yttrium iron garnet, spinel ferrite, hexaferrite, or a combination thereof that is of high relative magnetic permeability greater than 1.

6. The antenna of claim 1, wherein the gap varies from greater than 0 to about one electromagnetic wavelength.

7. The antenna of claim 1 wherein the magnetodielectric slabs comprise a Z-type hexagonal ferrite material with permeability $\mu'>7$ and magnetic Q $(\mu'/\mu'')>15$ at 500 MHz.

8. The antenna of claim 1, wherein the magnetodielectric slabs are shaped in circular, square, rectangle, triangular, pentagon or hexagon 2-dimension with a certain thickness.

9. The antenna of claim 1, wherein the gap is filled with air, dielectric, ferroelectric, magnetic material with lower magnetic permeability than that of the magnetodielectric slab, or the combination thereof.

10. The antenna of claim 1, wherein coil turns on the first slab and the coil turns on the second slab vary from one to as many as the slabs are capable of accommodating.

11. The antenna of claim 1, wherein a coil pitch of the first coil or the second coil ranges from 1 micron up to magnetodielectric slabs' dimension in the x-y plane.

12. The antenna of claim 1, wherein the first and second conductive wires are made of copper, silver, iron, steel, or an alloy thereof.

13. The antenna of claim 1, wherein the first and second conductive wires are round having a diameter or a flat strip.

14. The antenna of claim 1, wherein the first and the second magnetodielectric material slabs' x and y dimensions are placed horizontally aligned in an x-y plane, resulting in an omnidirectional azimuth radiation pattern with maximum signal strength in the x-y plane direction and minimum to null radiation signal in the z-direction.

15. The antenna of claim 1, wherein the antenna is mounted in a ground plane having a surface that is either smooth, rugged, planar, singly, or doubly curved, concave or convex convex-shaped, and said ground plane is made of a metal, an alloy of metals, dielectric, magnetic, magnetodielectric, ferroelectric, piezoelectric, or a combination these materials, said ground plane is a surface or fuselage of land, air, sea, space or amphibious vehicle.

16. The antenna of claim 15, wherein the ground plane is placed at a distance anywhere from 0 to a quarter EM wavelength $\lambda/4$, beneath or on top of the antenna along the z direction.

17. An antenna array, wherein multiple antennas of claim 1 are mounted either on top of one another or side by side, with a distance between the antennas less than one EM wavelength to increase the radiation peak gain in the azimuth to >3 dBi.

18. The antenna array of claim 17, wherein the multiple antennas are mounted in a ground plane having a surface that is either smooth, rugged, planar, singly or doubly curved, concave or convex convex-shaped, and the said ground plane is placed at a distance anywhere from 0 to a quarter EM wavelength $\lambda/4$, beneath or on top of the multiple antennas along the z direction.

19. The antenna array of claim 17, wherein the magnetodielectric material slabs comprise a material of yttrium iron garnet, spinel ferrite, hexaferrite, or a combination thereof.

20. A compact and efficient antenna, comprising:

at least two or more magnetodielectric material slabs being stacked together with a gap;

a first plurality conductive wires looping, at least, one first coil turn around the first magnetodielectric material slab, forming a first plurality of coils; and a second plurality conductive wires looping, at least, one second coil turn around the second magnetodielectric material slab, forming a second plurality of coils, wherein a power divider is used to split the source signal to feed the multiple coils wound around the slabs, producing an omnidirectional radiation in the azimuth plane with a gain equal to or greater than 3 dBi compared to a marine monopole antenna.

* * * * *